US005105498A

United States Patent [19]

Dinkelacker

[11] Patent Number: 5,105,498

[45] Date of Patent: Apr. 21, 1992

[54] DEVICE FOR CLEANING A SEWER

[75] Inventor: Albrecht Dinkelacker, Göttingen, Fed. Rep. of Germany

[73] Assignee: Max-Planck-Gesellschaft zur Foerderung der Wissenschaften e.V., Goettingen, Fed. Rep. of Germany

[21] Appl. No.: 628,015

[22] Filed: Dec. 17, 1990

[30] Foreign Application Priority Data

Feb. 21, 1990 [DE] Fed. Rep. of Germany ..... 4005510

[51] Int. Cl.[5] ..... B08B 9/04

[52] U.S. Cl. ..... 15/104.061; 15/3.51

[58] Field of Search ..... 15/104.061, 104.062, 15/104.063, 3.5, 3.51

[56] References Cited

U.S. PATENT DOCUMENTS

| | | | |
|---|---|---|---|
| 2,478,961 | 8/1949 | Wortham | 15/104.061 |
| 2,745,231 | 5/1956 | Prince | 15/104.061 |
| 4,336,074 | 6/1982 | Dinkelacker | 15/104.061 |

FOREIGN PATENT DOCUMENTS

| | | | |
|---|---|---|---|
| 0016434 | 3/1980 | European Pat. Off. . | |
| 2543622 | 3/1977 | Fed. Rep. of Germany . | |
| 263336 | 7/1971 | U.S.S.R. | 15/104.061 |

OTHER PUBLICATIONS

Patent Abstracts of Japan, vol. 10, No. 345 (P-521) (2410), Nov. 28, 1986.

*Primary Examiner*—Edward L. Roberts
*Attorney, Agent, or Firm*—Beveridge, DeGrandi & Weilacher

[57] ABSTRACT

Described herein is a device for cleaning a sewer of a kind which, under the action of the flowing sewage, is carried along the sewer by the sewage with a velocity less than the average velocity of sewage flow and which comprises a hollow cleaning ball immersing into the sewage and rolling on the bed or ceiling of the sewer. The outer surface of the cleaning ball has protrusions, the outer surface of the protrusions lie on an imaginary spherical surface. For adapting the effective weight of the cleaning ball to different levels of sewage in the sewer, several water through holes are distributed on the spherical wall of the cleaning ball which open into a sewage space within the hollow cleaning ball at a wall surface on which filth guiding ribs are. The filth guiding ribs end close to the openings of the water through holes.

22 Claims, 3 Drawing Sheets

DEVICE FOR CLEANING A SEWER

The invention relates to a device for cleaning a sewer of a kind which can be carried along the sewer under the action of the flowing sewage at a lower velocity than the average velocity of flow of the sewage. The cleaning device comprises a hollow cleaning ball, rolling along the bed of the sewer or the ceiling of the sewer when carried along the sewer, and immersing into the sewage, the cleaning ball having a plurality of protrusions on the outer side of its spherical wall, the contour of the protrusions lying on an imaginary spherical surface.

Such a device is especially known from DE-C-25 43 622 and EP-B-0 016 434. Since the device is carried along the sewer by the sewage at a lower velocity than the average velocity of flow of the sewage in the sewer, the cleaning ball forms a resistance to the flow of the sewage. Thus, the sewage in front of it is partly retained and the flow is disturbed under the formation of a deflecting flow passing the cleaning ball. Thereby, the deflecting flow acquires an increased velocity of flow so that deposits in front of and behind the cleaning ball are detached from the bed of sewer, flushed and washed away. In order to slow down the velocity of movement of the device a braking mass can be present within the hollow cleaning ball, e.g. a rigid pendulum pivotable about a shaft connected to the cleaning ball whilst overcoming a corresponding friction, a braking ball or the like, dissipatively rolling within the cleaning ball or a dissipatively flowable liquid and/or component filling like sand and water, which as a result of the rolling of the cleaning ball is always rearranged in different layers therein. Also a filling exclusively of water has proven to be good, where the shifting is throttled by the help of a throttling device within the cleaning ball. By the kind and the quantity of the braking mass, the movement of the cleaning ball can, in a wider scope, be influenced.

By means of the dimensions and/or the weight of such a braking mass, the weight of the cleaning ball can be adapted to the sewage level over the sewer bottom so that the cleaning ball, under its own weiqht, less its buoyancy, bears on the sewer bottom with adequate friction for its rolling movements in adaption to the sewage level. On the other hand, the sewage level in the sewer is not only dependant on daytime fluctuations and the meterological conditions, but it also varies along the length of the sewer, depending on the number of side inflows. If, however, the cleaning ball is too heavy for a low level of sewage, there is a danger that the pushing force of the sewage flow on the ball is too weak to make it roll and that the ball does not move at all. If, on the other hand, the weight of the cleaning ball is light, in adaption to a low level of sewage, the ball can, in case of a higher level of sewage, be transported away too fast so that the flow around the ball, which is necessary for the cleaning effect, becomes too weak and thus the cleaning effect is considerably reduced.

The invention solves the problem to create and design a device of the kind mentioned at the beginning which realizes a self-adaption of the effective weight of the cleaning ball to the different levels of sewage thereby keeping the maximal cleaning effect.

This is achieved in the invention by a plurality of water through holes, formed in the spherical wall, and distributed thereon, which through holes open into a sewage space in the interior of the hollow cleaning ball at a wall surface, on which filth guiding ribs are formed ending close to the openings of the water through holes.

With this invention, the water through holes in the spherical wall can be designed sufficiently big to avoid their clogging and, thereby, to avoid an accumulation of sand and other firm particles of filth in the cleaning ball, since during the rolling movement of the cleaning ball these firm particles of filth are led back to the openings by the filth guiding ribs and are floated out. The water through holes can have, e.g. a diameter of 15 mm, and e.g. six of them can be distributed over the spherical wall. The filth guiding ribs can be comparatively thin, e.g. can show a cross-section of 5×5 mm. They can, for example, consist of wires welded on the wall surface, or of rubber laces gummed on it or the like.

Therefore, according to the invention, the effective weight of the cleaning ball changes depending on whether it is filled with more or less sewage in dependance on the respective level of sewage in the sewer. The deceleration of the velocity of movement of the device can already be achieved by the existence of the protrusions, preferably designed in form of rubber beadings, on the outer surface of the spherical wall of the cleaning ball, since the rolling friction of the cleaning ball is increased by these protrusions. Additionally, the shifting of the sewage filling in the cleaning ball can contribute to its braking, especially since the filth guiding ribs offer a resistance to the shifting of the sewage, though only a minor resistance. However, in order to provide a more effective braking of the device, especially in cases of a higher level of sewage, preferably a braking device is designed on or in the cleaning ball that brakes the rolling movement thereof.

The braking device can, for example, be a throttle structure which throttles the shifting of the sewage in the cleaning ball. In this case, the braking effect based on the sewage filling which depends on the water-level, is itself contingent on the respective level of sewage. As a result, the braking effect on the cleaning ball in case of a low level of sewage, and therefore, in case of a minor driving force acting on the cleaning ball, is reduced. The braking effect may be increased, as desired, in case of a higher level of sewage. However, there is the possibility that the throttle openings of the throttling structure may become clogged by filth penetrating into the cleaning ball, as e.g. small pieces of paper. This is why at present a braking device is preferred which does not offer the possibility of any impairment of its effectiveness by soiling.

Especially, for this purpose, the braking member can be designed as a pendulum, suspended on a shaft extending along a diameter of the cleaning ball and being supported by the latter. Also, several of these pendulums of appropriate shape and mass can be provided. Preferably the pendulum is designed as a generally semicircular plate of which the circular edge part extends by only a small distance from the inner surface of the spherical wall of the cleaning ball. Thereby it can be achieved that the braking effect develops not only under the mass of the plate pendulum and its friction on the shaft, but to a certain extent also by throttling the shifting movement of the sewage in the gap between the edge of the plate and the spherical wall, with the throttling force changing in dependence on the quantity of sewage filling, and therefore, on the respective level of sewage in the sewer.

In another advantageous design of the invention, there is a hollow inner ball within the cleaning ball, placed concentrically to the latter and in spaced relation from the spherical wall, thereby forming two spaces by the interior of the inner ball and the intermediate space between the spherical wall and the inner ball, one of them forming a sewage space, the other being partly filled with a braking liquid and containing a throttling structure with a plurality of throttle-openings in order to develop the braking device. Thereby, an automatic adaption of the weight of the cleaning ball as well as a pre-determined, constant braking effect on the cleaning ball is achieved. Although it is possible to design the sewage space within the intermediate space and to place the braking device within the inner ball, it is preferable, because of the better conditions for the center of gravity, to design the sewage space within the inner ball and to place the braking device within the intermediate space.

According to the invention, it is even possible to design the braking device by constructing the proturbances on the outer surface of the spherical wall in the form of hollow beadings, the inner spaces of which being partly filled with a braking liquid and which preferably are connected with each other.

The suggestion according to the invention to create a sewage space within the cleaning ball which is connected by through holes to the outer surface of the cleaning ball, moreover offers the possibility of an additional influence on the effective weight of the cleaning ball by the arrangement of one or several buoyancy bodies of lesser specific weight than that of the water in the sewage space. If the cleaning ball is supposed to roll on the bed of sewer, the buoyancy body is preferably placed on the spherical wall of the cleaning ball, e.g. in the form of plates or disks, so that it can become effective even in case of a low level of sewage. By a corresponding distribution of several buoyancy bodies on the spherical wall, the rolling behavior of the cleaning ball can be influenced. If, on the other hand, the cleaning ball is supposed, at least in cases of a high level of sewage, to roll on the ceiling of the sewer, the buoyancy body can be placed in the midst of the cleaning ball, so that the contact pressure of the cleaning ball against the ceiling of the sewer increases with a raising level of sewage because of the increasing buoyancy.

The protrusions on the outer wall of the cleaning ball can be, e.g. knubs or ribs, but are preferably almost S-shaped beadings, particularly made of rubber or having a rubber jacket, the longside middles of the beadings lying on a common equatorial line of the cleaning ball. In order to increase the pushing force of the flowing sewage, especially in cases of a low level of sewage in the sewer, the beadings can show an irregular profile cross-section or be in any other way fissured or structured. For the same purpose, it is also possible to displace the S-shaped half-bows which respectively extend over one hemisphere of the spherical wall against the half-bows respectively extending over the outer hemisphere of the spherical wall along the equatorial line and/or to distribute single protusions between the S-shaped beadings.

BRIEF DESCRIPTION OF THE DRAWINGS

In the following the invention is illustrated by drawings in which.

DETAILED DESCRIPTION OF THE INVENTION

Figure 1:
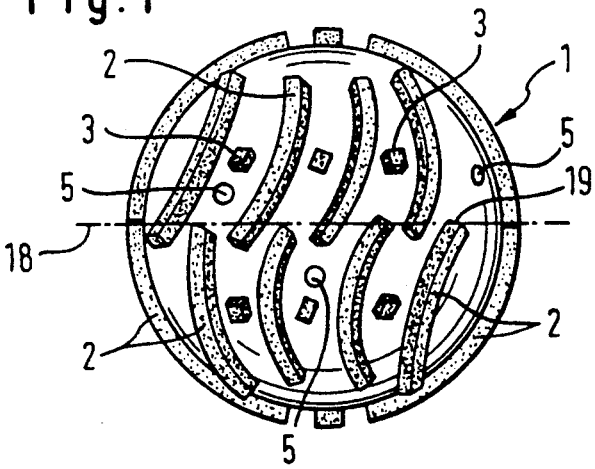
FIGS. 1 and 2 show a cleaning ball according to the invention in a side view, and a top plan view, respectively
Figure 2:
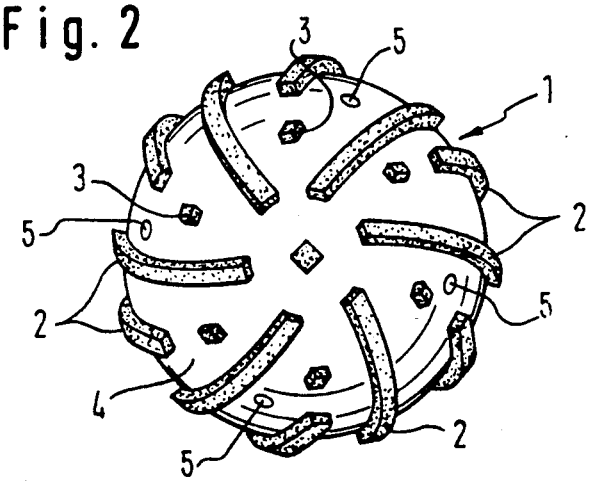

The cleaning ball 1 of the FIGS. 1 and 2 shows on the outer surface of its spherical wall a number of protrusions 2 in the form of S-shaped rubber beadings with a rectangular cross-section and a number of cube-shaped single protrusions 3 distributed between the rubber beadings 2. The longitudinal center lines of the rubber beadings 2 are designed on a common equatorial line 18 of the cleaning ball and their S-shaped semi-bows 19 are displaced from each other along the equatorial line 18. The interior of the hollow cleaning ball 1 forms, according to FIG. 3, a sewage space 6, into which several water through holes 5 open. The holes 5, e.g. with a diameter of 15 mm, are distributed along the spherical wall in the near vicinity of the equatorial line 18 and end on the inner wall surface 7 of the spherical wall 4. As it can also be seen best from FIG. 3, on the wall surface 7 there are four thin filth guiding ribs 8 rotationally symetrically distributed around the openings of each water through hole 5, which respectively are designed along of equatorial lines of the ball and end in the near vicinity of the water through hole 5.

By the help of the water through holes 5, the effective weight of the cleaning ball 1 is automatically adapted to the respective level of sewage in the sewer, whereas the filth guiding ribs 8 cause firm particles of filth, like sand, which have come into the sewage space through the water through holes 5, to be guided back to the water through holes 5 by the rolling movement of the cleaning ball 1 and are floated out through them.

Figure 3:
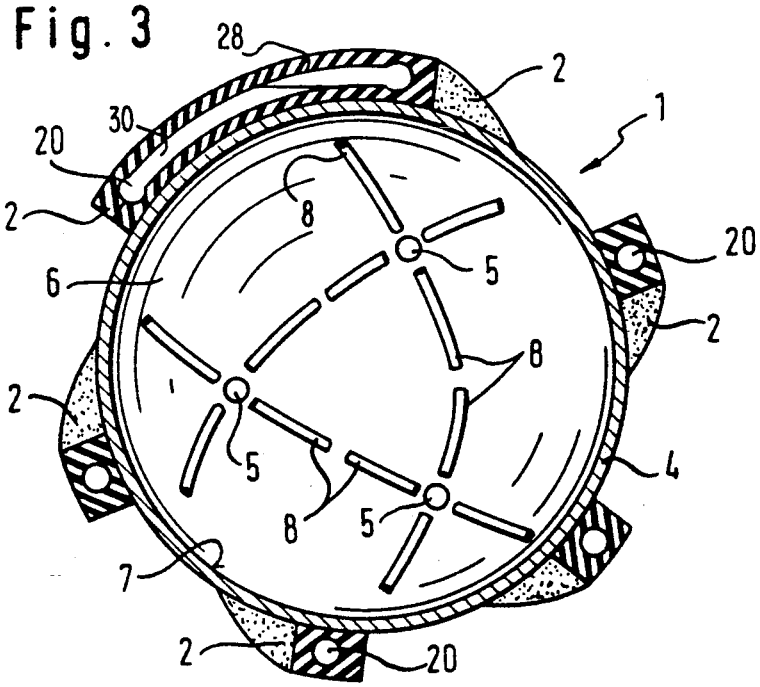
FIG. 3 shows a cross-sectional view of the cleaning ball according to FIGS. 1 and 2.

The rubber beadings 2 are hollow in order to reduce the weight, as shown in FIG. 3. Its cavities 20, however, can be connected by hollow cross-bars 28 and can be partly filled with a braking liquid 30 in order to brake the rolling movement of the cleaning ball 1 under the driving force of the sewage flow.

Figure 4:
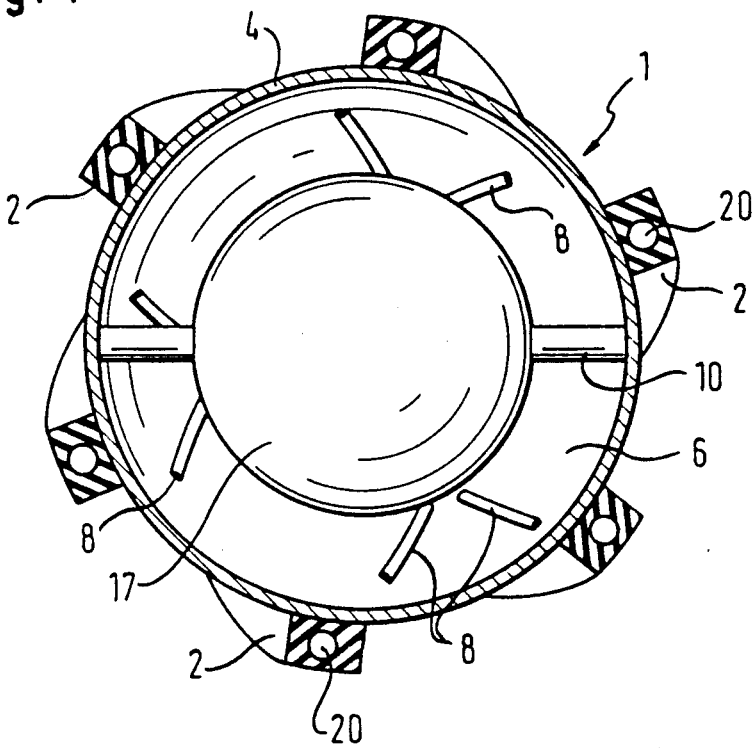
FIG. 4 shows a cross-sectional view of a cleaning ball with a central buoyancy body.

In the embodiment according to FIG. 4, there is a spherical buoyance body 17 of a lesser specific weight than that of water placed in the center of the sewage space 6 of the cleaning ball 1 on a shaft 10 which diametrically crosses the cleaning ball 1.

Figure 5:
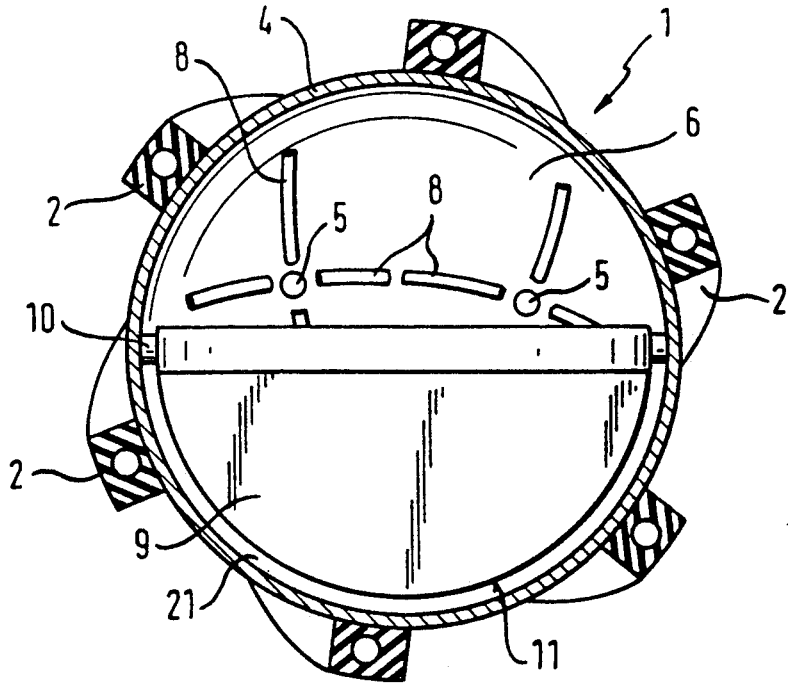
FIG. 5 shows a cross-sectional view of a cleaning ball with a braking device in the form of a pendulum plate.

In contrast, in the design according to FIG. 5 there is a pendulum 9, formed as a semi-circular plate, pivotable about the shaft 10, which also serves for braking the rolling movement of the cleaning ball. The pendulum plate 9, with its semi-circular edge part 11, extends by a small gap 21 spaced from the spherical wall 4 of the cleaning ball.

Figure 6:
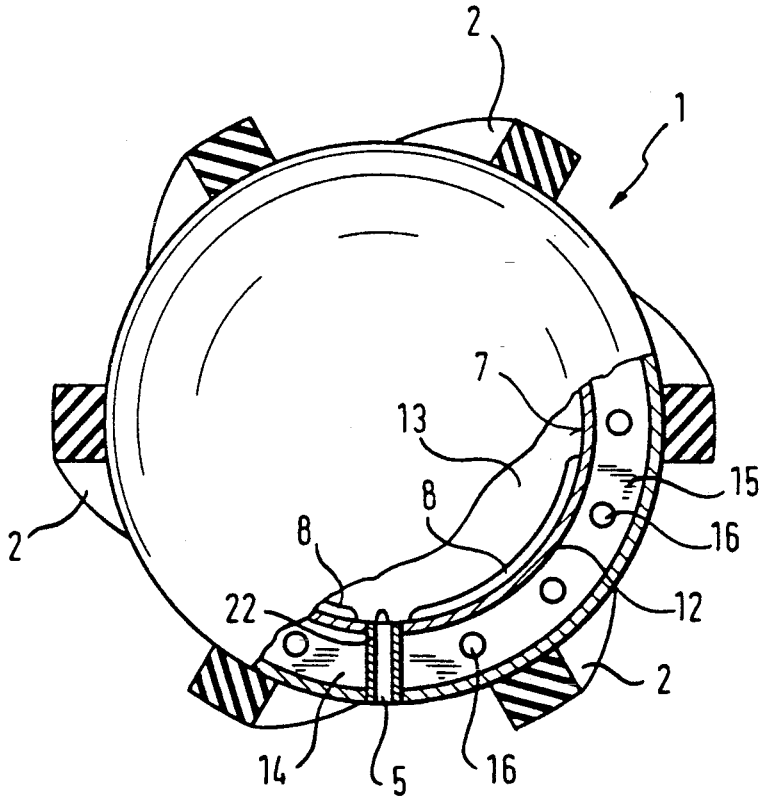
FIG. 6 shows a further design of a cleaning ball according to the invention in a partly open presentation.

According to FIG. 6, in the cleaning ball 1, a hollow inner ball 12 is supported with a diameter of about 4/5 of the diameter of the spherical wall 4 of the cleaning ball. The sewage space is created by the interior 13 of the inner ball 12, into which the water through holes 5 open at the inner wall surface 7 of the inner ball 12 through tube pieces 22, inserted between the balls 1, 12. On this wall surface 7, the filth guiding ribs 8 also are attached. In the intermediate space 14 between the balls 1, 12, a throttling structure 15 made of bar-like plates is installed in which throttling openings 16 are distributed, which act together with a braking liquid, which only partly fills the intermediate space 14, for braking the rolling movement of the cleaning ball 1.

I claim:

1. A device for cleaning a sewer, where under the action of flowing sewage, said device is carried along the sewer by the flowing sewage with a velocity lower than the average velocity of the flowing sewage, comprising:

a hollow cleaning ball defined by a spherical wall having an outer surface, said outer surface provided with protrusions, the protrusions defining an imaginary spherical surface, the cleaning ball, when carried along in the sewer, being at least partially immersed into the sewage and rolling on a bed or a ceiling of the sewer, wherein a plurality of water through holes are distributed over the spherical wall, forming openings at an inner wall surface into a sewage space within the hollow cleaning ball, filth guiding ribs being included on said inner wall surface, wherein an end of said ribs is located proximate the openings of the water through holes.

2. The device according to claim 1, further comprising a braking device within the cleaning ball, said braking device for slowing down the rolling movement of the cleaning ball, said braking device being constructed in a form of a pendulum suspended on a shaft extending along a diameter of the cleaning ball and being supported by the cleaning ball.

3. The device according to claim 2, wherein the pendulum is constructed as a substantially semi-circular plate, having a circular rim extending in a spaced relation to the spherical wall of the cleaning ball.

4. The device according to claim 1, further comprising a hollow inner ball having an interior space being placed concentrically within the cleaning ball, and being spaced from the spherical wall of the cleaning ball to form an intermediate space between the spherical wall and the inner ball, one of said interior space and said intermediate space forming said sewage space, the other space being closed and partly filled with a braking liquid and containing a throttling structure with a plurality of throttle openings.

5. The device according to claim 4, wherein the sewage space is located within the inner ball and the throttling structure is arranged within the intermediate space.

6. The device according to claim 1, wherein at least part of the protrusions are constructed as hollow beadings, thereby forming of a braking device, the interior the hollow beadings being connected with each other and being partially filled with a braking liquid.

7. The device according to claim 1, further comprising a buoyancy body having a specific weight less than that of water being placed within the sewage space.

8. The device according to claim 1, wherein at least some of the protrusions on the cleaning ball are S-shaped beadings, the longitudinal center lines of which are patterned on a common equatorial line of the cleaning ball.

9. The device according to claim 8, wherein the equatorial line seperates a first and a second hemispherical surface of the spherical wall from each other, the S-shaped beadings having first half-bows on said first hemispherical surface and having second half-bows on said second hemispherical surface, said first half-bows being displaced against said second half-bows along said equatorial line.

10. The device according to claim 8, wherein single protusions are distributed between the S-shaped beadings.

11. A device for cleaning a sewer, comprising:

a spherical wall defining a hollow cleaning ball, said spherical wall having an outer surface and an inner surface;

a plurality of protrusions on said outer surface of said spherical wall;

a plurality of water through holes distributed on said outer surface of said spherical wall, said water through holes opening into the interior of said cleaning ball; and a plurality of filth guiding ribs located in the interior of the cleaning ball.

12. The device according to claim 11, further comprising a braking device in the interior of the cleaning ball, said braking device including a pendulum suspended on a shaft extending along a diameter of the cleaning ball and being supported by the cleaning ball.

13. The device according to claim 12, wherein said pendulum includes a substantially semicircular plate, having a circular rim extending in a spaced relation to the spherical wall of the cleaning ball.

14. The device according to claim 11, further comprising a hollow inner ball defining an interior space, said inner ball located in the interior of the cleaning ball and spaced apart from the spherical wall of the cleaning ball, thereby defining an intermediate space between the spherical wall and the inner ball, said water through holes opening either into said interior space or said intermediate space, the space without the water through hole opening being closed and partially filled with a braking liquid.

15. The device according to claim 14, wherein the space which is partially filled with the braking liquid further includes a throttling structure with a plurality of throttle openings.

16. The device according to claim 14, wherein the water through holes open into the interior space.

17. The device according to claim 15, wherein the throttling structure is located in the intermediate space.

18. The device according to claim 11, wherein at least part of the protrusions define hollow beadings which form a braking device, the hollow beadings being connected together and partially filled with a braking liquid.

19. The device according to claim 11, further comprising a buoyancy body having a specific weight less than that of water located in the interior of the cleaning ball.

20. The device according to claim 11, wherein at least some of the protrusions on the cleaning ball are S-shaped beadings.

21. The device according to claim 20, wherein an equatorial line separates a first and a second hemispherical surface of the spherical wall from each other, the S-shaped beadings having first half-bows on said first hemispherical surface and having second half-bows on said second hemispherical surface, said first half-bows being displaced from said second half-bows along said equatorial line.

22. The device according to claim 20, wherein single protrusions are distributed between the S-shaped beadings.

* * * * *